United States Patent [19]

Helling

[11] Patent Number: 4,513,080

[45] Date of Patent: Apr. 23, 1985

[54] PHOTOGRAPHIC SILVER HALIDE CONTAINING RECORDING MATERIAL WITH CROSSLINKED MICROGEL PARTICLES

[75] Inventor: Günter Helling, Odenthal, Fed. Rep. of Germany

[73] Assignee: Agfa-Gevaert AG, Leverkusen, Fed. Rep. of Germany

[21] Appl. No.: 648,616

[22] Filed: Sep. 10, 1984

Related U.S. Application Data

[63] Continuation of Ser. No. 488,362, Apr. 25, 1983, abandoned.

[30] Foreign Application Priority Data

May 6, 1982 [DE] Fed. Rep. of Germany ..... 32170203

[51] Int. Cl.[3] ..... G03C 1/72

[52] U.S. Cl. ..... 430/537; 430/539; 430/627; 430/628; 430/631; 430/640

[58] Field of Search ..... 430/537, 539, 627, 628, 430/631, 640

[56] References Cited

U.S. PATENT DOCUMENTS

| | | | |
|---|---|---|---|
| 3,591,387 | 7/1971 | Brust et al. | 430/627 |
| 3,615,624 | 10/1971 | Smith | 430/627 |
| 3,713,829 | 1/1973 | Nishio et al. | 430/628 |
| 3,816,129 | 6/1974 | Fitzgerald | 430/627 |
| 3,852,073 | 12/1974 | Fitzgerald | 430/627 |
| 4,128,427 | 12/1978 | Mombaliu et al. | 96/100 |
| 4,145,220 | 3/1979 | Timmerman et al. | 430/537 |
| 4,193,796 | 3/1980 | Campbell et al. | 430/227 |
| 4,193,800 | 3/1980 | Iwama et al. | 430/213 |
| 4,234,671 | 11/1980 | Iwama et al. | 430/213 |
| 4,288,523 | 9/1981 | Taylor | 430/537 |
| 4,362,812 | 12/1982 | Minamizono et al. | 430/631 |

FOREIGN PATENT DOCUMENTS 2029593 3/1980 United Kingdom .

*Primary Examiner*—Jack P. Brammer

*Attorney, Agent, or Firm*—Connolly and Hutz

[57] ABSTRACT

A photographic recording material consisting of a layer support, at least one light-sensitive silver halide emulsion layer containing gelatine and optionally other gelatine-containing layers which are not light-sensitive contains in at least one of the layers a cross-linked polymer latex on the basis of a low molecular weight carboxylic acid amide. The latex may advantageously be used as a binding agent or for introducing residues of photographically active substances into a photographic layer.

2 Claims, No Drawings

PHOTOGRAPHIC SILVER HALIDE CONTAINING RECORDING MATERIAL WITH CROSSLINKED MICROGEL PARTICLES

CROSS-REFERENCE TO RELATED APPLICATION

This is a continuation of U.S. patent application Ser. No. 488,362, filed Apr. 25, 1983 and now abandoned for Photographic Recording Material by Gunter Helling.

This invention relates to a photographic recording material containing cross-linked polymer latices in light-sensitive and light-insensitive photographic layers.

The binder used for photographic layers is generally gelatine on account of its advantageous properties as a protective colloid and dispersing agent and its chemical properties. Gelatine does, however, also have certain disadvantages as a photographic binder, as for example the inadequate dimensional stability under changing climatic conditions, i.e. variations in temperature and moisture, to which the layers formed from it are subject.

There has therefore been no lack of attempts to replace gelatine partly or completely by other binders. DE-OS 2 442 165, for example, discloses film-forming addition polymers or copolymers based on acrylamide which can be hardened with gelatine hardeners and may be used as gelatine substitutes or gelatine modifying agents. U.S. Pat. No. 3,026,293 describes acrylamide graft polymers which have the characteristic when prepared as films of being permeable to water vapour but not to water. These polymers may be used as gelatine substitutes in photographic layers.

One disadvantage of these polymers is that, when mixed with gelatine, they increase the viscosity of the coating solutions, especially if the cross-linking agents required to harden the layers are added to the coating solutions. This leads to an increase in viscosity during the dwell times of the casting solutions required for the coating process so that the solutions cannot be applied evenly in a uniform quantity per unit area. Furthermore, linear high molecular weight polyacrylamides are so highly viscous in the form of aqueous solutions that it is very difficult to work with such solutions.

It is an object of the present invention to prepare cross-linked polymer latices which are not liable to undergo hydrolysis, do not impair the sensitometric properties of color photographic materials, are compatible with the usual binders and can be prepared by a simple method.

This problem is solved according to the invention by means of a photographic recording material consisting of a layer support, at least one light-sensitive silver halide emulsion layer containing gelatine and optionally other gelatine-containing layers which are not light-sensitive, characterised in that at least one of the layers of the recording material contains a cross-linked polymer latex corresponding to the formula:

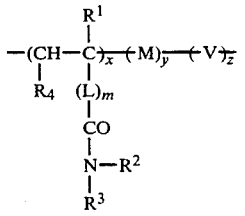

wherein $R^1$ denotes a hydrogen atom or alkyl group having 1 to 6 carbon atoms, $R^2$ denotes a hydrogen atom, a straight chained or branch chained, substituted or unsubstituted alkyl group having 1 to 6 carbn atoms, an aralkyl residue such as benzyl- or 2-phenyl-ethyl, a substituted or unsubstituted aryl residue such as phenyl, hydroxynaphthyl or 2-hydroxy-3-carboxyphenyl, a 5-membered or 6-membered substituted or unsubstituted heterocyclic ring containing oxygen, sulfur or nitrogen as hetero atoms, such as an alkylpyrazolyl ring, an alkylpyridine ring, an N-alkylimidazole ring or an alkylpiperidine ring, or a residue of a substance which is active in the photographic layer, $R^3$ has the meaning indicated for $R^2$, and may be identical to or different from $R^2$, with the proviso that only $R^2$ or $R^3$ may be the residue of a substance which is active in the photographic layer, $R^4$ denotes a hydrogen atom or the group —$COOR^1$, L denotes a bivalent group such as an alkylene residue having 1 to 6 carbon atoms. an arylene residue having 6 to 10 carbon atoms, e.g. phenylene or naphthylene, an arylene-alkylene residue having 7 to 11 carbon atoms, e.g. phenylene methylene or phenylene ethylene, or a group —$COOR^5$ or —$CONHR^5$ wherein $R^5$ may be one of the above mentioned bivalent groups, M denotes the residue of polymerised monomers having a polymerisable ethylenically unsaturated group, V denotes a residue formed from a polymerised monomer having at least two ethylenically unsaturated groups, m is 0 or 1, preferably 0, x represents at least 10% by weight, y represents 89.5 to 0% by weight and z represents 10 to 0.5% by weight and the sum of the parts by weight of x, y and z should in each case amount to 100%.

The cross-linked polymer latices according to the invention, hereinafter briefly referred to as "latices",may advantageously be used wherever it is desired to use a synthetic binder and avoid the disadvantages of the sharp increase in viscosity which this generally entails. The latices are also suitable for introducing residues of photographically active substances into a photographic layer in the form of substituents.

The structural unit characterised by the general formula constitutes the polymerised form of a low molecular weight carboxylic acid amide. Suitable monomeric carboxylic acid derivatives are those which are copolymerisable with the monomers M and V described below, e.g. derivatives of methacrylic acid, acrylic acid, crotonic acid, maleic acid or (vinyl phenyl)-acetic acid.

$R^2$ and $R^3$ stand for hydrogen, alkyl, aralkyl, aryl or a group which functions as a photographic unit, as, for example, a color coupler, a UV absorbent, a white coupler, a dye, a developer, a dye releasing compound, an optical brightening agent, a metal ion donor, an antifogging agent, a toner or a compound which is reactive with formalin. In such cases, $R^2$ or $R^3$ would generally be a residue having one of the functions mentioned above although in principle $R^2$ and $R^3$ could together constitute such a residue.

In a preferred embodiment, $R^2$ or $R^3$ is a colour coupler residue capable of entering into oxidative coupling with an oxidized p-phenylene diamine compound.

The term "oxidative coupling" means the formation of a dye by reaction of the oxidized form, for example of a phenylene diamine, with a nucleophilic agent. In the photographic process, the precursor of a nucleophile, for example of a colour coupler, is converted into a nucleophile under the conditions of development, i.e. under alkaline conditions.

Colour coupling compounds which are contained as structural elements in the usual color couplers are representative of residues $R^2$ or $R^3$. The following colour coupling residues are given as examples:

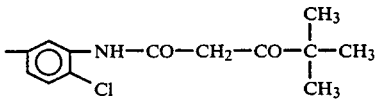
$R_A$

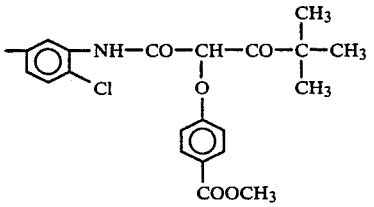
$R_B$

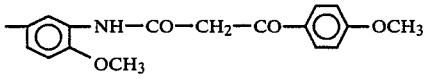
$R_C$

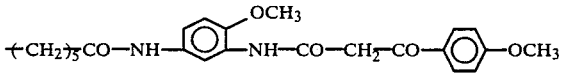
$R_D$

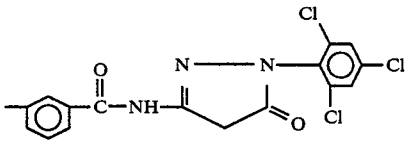
$R_E$

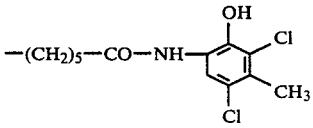
$R_F$

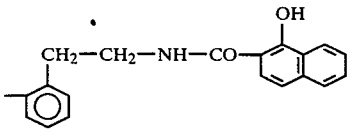
$R_G$

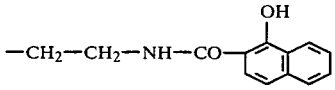
$R_H$ $R^2$ and $R^3$ may also, as mentioned above, represent other residues of agents which are active in the photographic layer, the following being mentioned as examples:

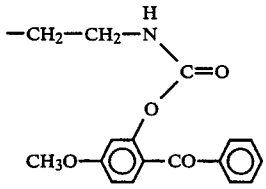
$C_1$

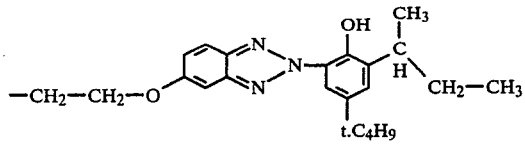
$C_2$

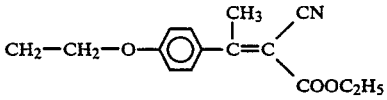
$C_3$

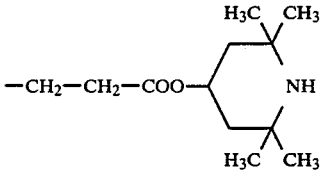
$C_4$

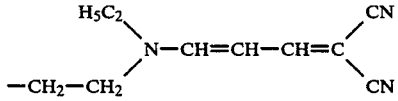
$C_5$

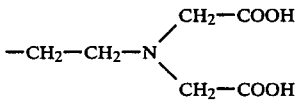
$C_6$

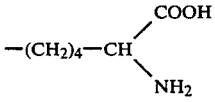
$C_7$

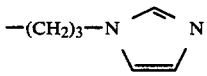
$C_8$

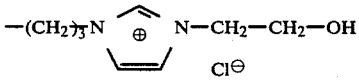
$C_9$

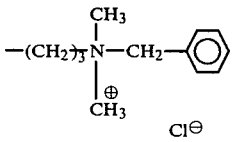
$C_{10}$

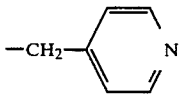
$C_{11}$

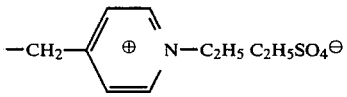
$C_{12}$

-continued $C_{13}$

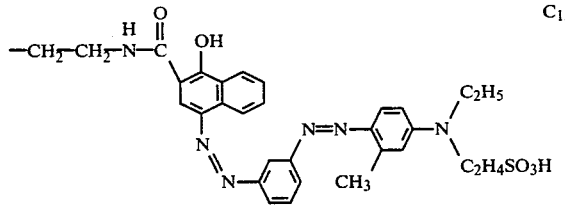

Compounds representing $R^2$ or $R^3$ include, for example, compounds which are capable of fixing diffusible anionic dyes, a process which is of interest, for example, for dye diffusion processes or for fixing filter dyes. This property is characteristic in particular of compounds containing imidazolinium, pyridinium or tetraalkyl ammonium groups, as exemplified by the above compounds $C_9$, $C_{10}$ and $C_{12}$.

The polymer latices according to the invention may advantageously contain $R^2$ and $R^3$ in the form of residues attached to the nitrogen atom through an alkylene group to stabilize the photographic material against UV light and/or oxidative degradation. Examples of such residues are those represented by formulae $C_1$ to $C_5$.

The above mentioned residues $C_6$ and $C_7$ are examples of residues forming complexes with metal ions, which may be useful, for example, for forming metal complex dyes in photographic layers. Such residues advantageously contain amino carboxylic acid groups.

V denotes the residue formed from a monomer which contains at least two ethylenically unsaturated groups and is capable of undergoing addition polymerisation, the monomer corresponding to the following formula:

$$(CH_2{=}\overset{\overset{R^6}{|}}{C})_n{-}R^7$$

wherein $n_6$ is an integer greater than 1, preferably 2, 3 or 4, $R^6$ denotes a hydrogen atom or a methyl group and $R^7$ denotes an n-valent organic residue.

$R^7$ may denote, for example, a divalent or higher valent organic residue which may be built up or alkylene, arylene, aralkylene or cycloalkylene groups (or, in the case of higher valent organic residues, it may be built up of the corresponding higher valent analogues of the said groups) or of ester, sulfonyl ester, amide or sulfonamide groups, ether oxygen atoms or thioether sulphur atoms or combinations of the above mentioned groups and atoms. $R^7$ may denote, for example, a methylene, ethylene, trimethylene, phenylene, phenylene-dioxycarbonyl, 4,4' isopropylidene-bis-phenylene oxycarbonyl, methylene oxycarbonyl, ethylene-dioxycarbonyl, 1,2,3-propane-tri-yl-tris-(oxycarbonyl), cyclohexylene-bis-(methylene oxycarbonyl), ethylene-bis-(oxyethylene-oxycarbonyl) or an ethylidene-trioxy carbonyl group. It is preferred to use monomers which are stable in the presence of strong alkali and not particularly reactive so that no hydrolysis will take place during copolymerisation.

The following are examples of monomers of which the units (V) may be composed: divinylbenzene; allyl acrylate; allyl methacrylate; N-allyl methacrylamide; 4,4-isopropylidene-diphenyl-diacrylate; 1,3-butylene-diacrylate; 1,3-butylene-dimethacrylate; 1,4-cyclohexylene-dimethylene-dimethacrylate; di-ethyleneglycol-dimethacrylate; di-isopropylene-glycol-dimethacrylate; ethylene-diacrylate; ethylene-dimethacrylate; ethylidene-diacrylate; 1,6-diacrylamidohexane; 1,6-hexamethylene-diacrylate; 1,6-hexamethylene-dimethacrylate; N,N'-methylene-bis-acrylamide; neopentyl glycol-dimethacrylate; tetraethyleneglycol-dimethacrylate; tetramethylene-diacrylate; tetramethylene-dimethacrylate; 2,2,2-trichloro-ethylidene-dimethacrylate; triethyleneglycol-diacrylate; triethylene glycol-dimethacrylate; ethylidene-trimethacrylate; 1,2,3-propane-tri-yl-triacrylate; vinyl methacrylate; 1,2,4-trivinylcyclohexane; tetraallyloxyethane.

Particularly advantageous monomers for the formation of units V are: trivinylcyclohexane, divinyl-benzene, tetraallyloxyethane and 1,4-butylidene-dimethacrylate. Two or more of the above mentioned monomers may be used together to form the units V of the polymers acording to the invention.

A wide variety of monoethylenically unsaturated monomers capable of copolymerising with the usual monomers may be used for the units M and monomers having conjugated ethylenically unsaturated bonds are also suitable. The following are typical examples of suitable monomers M: ethylene, propylene, 1-butene, 4-methylpentene-1, styrene, α-methylstyrene, monoethylenically unsaturated esters of aliphatic acids, e.g. vinyl acetate, isopropenyl acetate, allyl acetate and the like; esters of ethylenically unsaturated mono- and dicarboxylic acids, e.g. methyl methacrylate, ethyl acrylate, glycidyl acrylate, glycidyl methacrylate, butyl acrylate, cyanomethyl(meth)acrylate, nitrophenyl(meth)acrylate, carbomethoxymethyl(meth)acrylate and carbethoxymethyl(meth)acrylate, and other monoethylenically unsaturated compounds such as, for example, acrylonitrile, allyl cyanide and certain conjugated dienes, such as butadiene, isoprene and 2,3-dimethylbutadiene.

Water-soluble monomers are particularly suitable, e.g. acrylic acid, methacrylic acid, itaconic acid, maleic acid, acrylamido-2-methyl-propane sulphonic acid, sulphoethyl methacrylate, N-vinylpyrrolidone, vinyl pyridine and dimethylaminoethyl methacrylate.

The group M need not necessarily be formed from a single monomer but may be formed from several of the above mentioned monomers.

The latices according to the invention may be prepared by various methods. According to one preferred method of preparation, cross-linked polymer latices are reacted by polymer analogous reactions to form the polymeric amides. Suitable starting compounds include, for example, cross-linked (meth)acrylic acid ester latices, which react with amines to form the polymeric amides according to the invention.

The latices used as starting materials may be prepared inknown manner by emulsion copolymerisation of monomeric polymerisable esters with polyfunctional monomers, as described, for example, in DE-OS 2 652 464. The monomeric esters used preferably have sufficient reactivity for the aminolysis to be carried out in the next stage. Examples of monomeric esters suitable for the preparation of the cross-linked starting latices are: (meth)acrylic acid methyl ester, cyanomethyl(meth)acrylate, nitrophenyl(meth)acrylate, carbomethoxymethyl(meth)acrylate, carbethoxymethyl(meth)acrylate and chloromethyl(meth)acrylate.

The preparation of reactive esters is known from the chemistry of peptides (Houben-Weyl, Vol. 15/1 (1974), page 28). The synthesis of reactive (meth)acrylic acid esters has ben described in Makromol. Chem. 181, 2485 (1980) and European Polymer Journal 15, 167 (1979).

Other reactive derivatives of polymerisable acids are also suitable for the preparation of the latices used as starting materials. Examples include N-hydroxyphthalimide esters (European Polymer Journal 15, 603 (1979)); acrylic acid benzotriazolides (J. Polym. Sci. Chem. Ed. 16, 1435 (1978)) and methacryloylimidazole (J. Polym. Sci. Chem. Ed. 12, 2453 (1974)).

Another method of preparation starts with cross-linked (meth)acrylic acid latices such as those described in DE-OS 2 652 464. In this case, it is necessary to activate the carboxylic acid groups before the reaction with amines. Methods of activating carboxylic acid groups are known and have been described, for example, in Houben-Weyl, Volume 15/1 (1974), page 28. The acid groups may also be activated by conversion into the acid halide or anhydride form. The reagents known from low molecular weight chemistry are suitable for this purpose, e.g. thionyl chloride, phosphorus pentachloride, phosphorus trichloride or acetic anhydride.

The cross-linked reactive latices used as starting compounds are then reacted with the amines to form the polymer latices according to the invention. These latices may be used in the form of aqueous dispersions. If they can react with water, they are used as dispersions containing organic, preferably polar organic solvents as dispersing agents. It is in many cases also suitable to use mixtures of water and organic solvents as dispersing agents.

The reaction conditions, such as reaction time, temperature and the use of catalysts, depend on the particular latex used as starting compound. These conditions can generally be chosen along the lines known from analogous reactions of linear, non-cross-linked polymers or from low molecular weight chemistry. Descriptions of these possibilities may be found in Houben-Weyl, Volume 14/2 (1963), page 738, Makromol. Chem., Rapid Connun. 1,655 (1980), European Polymer Journal 15, 167 (1979), J. Polym. Sci. Chem. Ed. 12, 2453 (1974), J. Polym. Sci. Chem. Ed. 16, 1435 (1978), J. Polym. Sci. Chem. Ed. 12, 553 (1974), Makromol. Chem. 175, 391 (1974) Makromol. Chem. 178, 2159 (1977) and Makromol. Chem. 181, 2495 (1980).

Amines suitable for the preparation of the latices according to the invention have the structure:

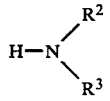

wherein $R^2$ denotes a hydrogen atom, a straight chained or branch chained, substituted or unsubstituted alkyl group having 1 to 6 carbon atoms, an aralkyl residue such as benzyl or 2-phenylethyl, a substituted or unsubstituted aryl residue such as phenyl, hydroxy-naphthyl or 2-hydroxy-3-carboxyphenyl, a 5-membered or 6-membered substituted or unsubstituted heterocyclic ring containing oxygen, sulfur or nitrogen as hetero atoms, such as an alkyl pyrazolyl ring, alkyl pyridinine ring, N-alkylimidazole ring or alkylpiperidine ring, or a residue of an agent which is active in the photographic layer, and has the meaning of $R^2$, and $R^2$ and $R^3$ may be identical or different, with the proviso that only $R^2$ or $R^3$ may be the residue of an agent active in the photographic layer.

Examples of suitable amines include ammonia, alkylamines, e.g. methylamine, dimethylamine, ethylamine, propylamine or butylamine, arylamine, e.g. aniline or 4-methylaniline, substituted or unsubstituted aminophenols, aralkylamines, e.g. substituted or unsubstituted butylamines, aminocarboxylic acids, e.g. lysine or glycine, alkylene diamines, e.g. diaminoethane, diamonohexane or N,N'-dimethylaminopropylene diamine, hydroxyalkylamines, e.g. aminoethanol, alkoxyalkylamines, e.g. methoxyethylamine, aminopyridines, e.g. 4-aminomethylpyridine, aminoalkylimidazoles, e.g. N-3-aminopropyl-imidazole, aminoureas, e.g. aminoethyl urea, secondary cyclic amines in which $R^2$ and $R^3$ together form a residue, e.g. morpholine or piperidine, and amines corresponding to the structure

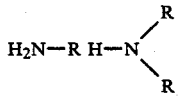

wherein the R radicals denote photographically active residues as listed in the examples above.

The particles of the latices according to the invention generally have a diameter of from 20 nm to 1 μm, preferably from 30 to 300 nm. The latices are compatible with the usual binders used in photographic materials, e.g. gelatine, polyvinyl alcohol, carboxymethyl cellulose or hydroxyethyl cellulose, and they form transparent layers when mixed with these binders.

The latices may be purified by the methods known in the art, such as flocculation or redispersion, dialysis, ultrafiltration or by mixing with gelatine, shredding and washing.

The latices may be stabilized by wetting agents although this is frequently not necessary, especially is the latices contain ionic groups such as carboxyl or sulfonyl groups or quaternary ammonium groups.

The latices are generally used in the form of aqueous dispersions. When they are prepared in a nonaqueous medium, the solvent is removed by known methods, e.g. by distillation, dialysis, ultrafiltration or flocculation and redispersion.

When the latices are to be employed in photographic layers, they are generally mixed with natural or synthetic binders such as gelatine or other hydrophilic macromolecular substances. The quantity of latex added is normally from 20 to 80% be weight, preferably from 50 to 85% by weight, based on the total quantity of binder used. The latices according to the invention are preferably used in admixture with gelatine as a binder.

The latices according to the invention may be used with advantage in various photographic materials, both in the light-sensitive layers and in the light-insensitive layers of these materials. Examples of light-insensitive layers include receptor layers such as those used in diffusion transfer materials, and photographic auxiliary layers which are used in combination with light-sensitive layers. In such layers, the latices may be used either as binders or to modify the binder. They are also suitable as a basis for polymer couplers or other polymeric auxiliary substances which may be used in numerous radiation sensitive materials such as lithographic plates, photoresist materials and electrophotographic, electrostatographic and radiographic materials.

The following Examples serve to illustrate the invention.

Starting latex A:

A mixture of 163 g of water, 1.1 g of a 30% by weight aqueous solution of an anionic wetting agent corresponding to the formula

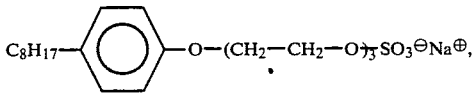

16 g of cyanomethyl acrylate and 0.65 g of 1,2,4-trivinylcyclohexane was heated to 60° C. under nitrogen. After 10 minutes' stirring, a solution of 0.16 g of potassium peroxydisulfate in 8 g of water and a solution of 0.16 g of sodium metabisulfite in 8 g of water were simultaneously introduced dropwise over a period of one hour. The reaction mixture was stirred for 3 hours at 60° C. The latex obtained was filtered. It had a solids content of 8.6% by weight.

Starting latex B:

A mixture of 200 g of water, 2.5 g of a 30% by weight solution of the wetting agent used for starting latex A, 29.4 g of carbomethoxymethyl acrylate and 1.2 g of divinylbenzene was heated to 75° C. under nitrogen. After 10 minutes' stirring, a solution of 0.3 g of potassium peroxydisulfate in 10 g of water and a solution of 0.3 g of sodium metabisulfite in 10 g of water were simultaneously introduced dropwise over a period of one hour. After a further 3 hours' stirring at 75° C., the latex obtained was filtered. The solids content was 11.5% by weight.

Starting latex C:

The method of preparation was the same as that described for latex B except that 2.4 g of divinylbenzene were used.

Starting latex D:

This latex was prepared by the same method as latex B except that 3.6 g of divinylbenzene were used.

Starting latex E:

The method of preparation was the same as for latex B except that 1.5 g of 1,2,4-trivinylcyclohexane were used instead of divinylbenzene.

Latex 1

100 g of starting latex B were mixed with 5.6 g of N,N'-dimethyl-aminopropylamine and the mixture was stirred for 8 hours at 95° C. The low molecular weight constituents were then removed by dialysis under running water. The degree of conversion was determined by elemental analytical measurement of the nitrogen value:

$$\text{Degree of conversion } U = \frac{N_{el.}\text{ measured} \cdot 100}{N_{el.}\text{ calculated for complete conversion}} \ [\%]$$

$$U = 57\%.$$

Latices 2 to 13

Starting latices A to E were reacted with various amines as described for latex 1. The reaction conditions and degrees of conversion are shown in the following Table 1.

Latices 3, 4, 9, 10 and 12 are suitable for use as binder additives. Lattices, 1,2, 5, 6, 7, 8, 11 and 13 are suitable for fixing metal ions, e.g. $Cu^{++}$, $Zn^{++}$, $Ni^{++}$, while latices 1, 2, 6, 8, 11 and 13 may in addition be used as mordants after quaternization with alkyl compounds such as benzyl chloride, dimethylsulfate, epichlorohydrin or chloroethanol.

TABLE 1

| Latex | Starting latex | Amine | Reaction Temp. | Reaction Time | Degree of conversion U |
|---|---|---|---|---|---|
| 1 | B | $H_2N—(CH_2)_3—N(CH_3)_2$ | 95° C. | 8 h | 57% |
| 2 | B | Aminoethylpiperazine | 95° C. | 6 h | 57% |
| 3 | B | n-propylamine | 95° C. | 6 h | 47% |
| 4 | C | n-propylamine | 95° C. | 6 h | 13% |
| 5 | C | Diaminoethane | 95° C. | 10 h | 43% |
| 6 | C | Dimethylaminopropylamine | 95° C. | 6 h | 54% |
| 7 | D | Diaminoethane | 95° C. | 12 h | 45% |
| 8 | D | Dimethylaminopropylamine | 95° C. | 18 h | 43% |
| 9 | D | Propylamine | 95° C. | 6 h | 15% |
| 10 | E | Propylamine | 95° C. | 5 h | 51% |
| 11 | A | Dimethylaminopropylamine | 60° C. | 6 h | 69% |
| 12 | B | Ammonia | 90° C. | 10 h | 73% |
| 13 | B | Aminopropylimidazole | 90° C. | 10 h | 62% |

Latex 14

50 ml of isopropanol were added to 100 ml of latex 11 which had a solids content of 14.8% by weight. 9.1 g (0.072 mol) of benzyl chloride were then added at 60° C. The reaction mixture was heated to 60° C. for 6 hours and then dialysed against running water. The latex obtained had the properties of a mordant.

Latex 15

4.7 g (0.058 mol) of chloroethanol were added at 60° C. to 100 ml of latex 13 which had a solids content of 16.2% by weight. The reaction mixture was heated to 90° C. for 8 hours and the latex obtained was then dialysed against running water. The resulting latex had the properties of a mordant.

Latex 16

KOH was added to starting latex A (8.6% by weight aqueous dispersion) in an amount of 20 mol-%(based on the ester groups) and the mixture was stirred at 30° C. After one hour, the pH of the latex had fallen to 7.5. The latex was then reacted with 2,4-dichloro-3-methyl-6-(5-aminopentylcarbonamido)-phenol in water-/acetonitrile by the method described for latex 2. A cross-linked latex containing carboxylate groups and color coupling groups was obtained after dialysis. The degree of conversion was 38% by weight, based on the color coupling groups.

Latex 17

200 ml of dimethylformamide were added to 100 g of a 10.6% by weight cross-linked copolymer latex of acrylic acid and trivinylcyclohexane described in Example 8 of DE-OS 2 652 464. After removal of the water by distillation, a solution of 22.9 g of carbonyldiimidazole in 80 ml of dimethylformamide was introduced dropwise at 20° C. When evolution of gas had ceased, a solution in 135 ml of dimethylformamide of 26 g of compound $H_2N$-$R_A$ wherein $R_A$ denotes the colour coupling residue defined above, was added dropwise and the reaction mixture was stirred for 4 hours at 40° C. The latex was then flocculated by the addition of a cyclohexane/acetone mixture and the polymer was filtered off, washed and redispersed in water. The resulting latex contained the coupler residue $R_A$. The conversion determined from the acid number was found to be 55%.

EXAMPLE 1

100 ml of a 10% by weight aqueous solution of binder consisting of a mixture of gelatine and linear high molecular weight polyacrylamide in proportions by weight of 10:1 and 100 ml of a 0.2% by weight solution in water of hardener A defined below were cast by means of a conventional cascade casting machine on to a cellulose triacetate support covered with an adhesive layer, and dried.

Hardener A has the following formula:

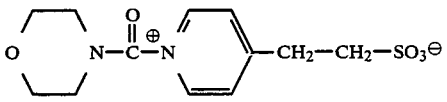

The material was stored for 7 days at 30° C. and 50% relative humidity. The wet scratch strength (NKF) and swelling factor (QF) were then determined.

To determine the wet scratch strength, a metal tip of specified size is passed over the wet layer and loaded with a progressively increasing weight. The wet scratch strength is expressed in terms of the weight at which the tip leaves a visible scratch trace on the layer. A heavy weight corresponds to high wet scratch strength.

Swelling is determined gravimetrically after treatment of a sample strip in distilled water at 22° C. for 10 minutes. It is defined by the swelling factor as follows:

$$\frac{\text{Weight of wet layer}}{\text{Weight of dry layer}} = \text{Swelling factor}$$

The example was repeated but using latices 6 and 12 according to the invention instead of polyacrylamide. The changes (in %) of swelling factor (ΔQF) and wet scratch strength (ΔNKF) were determined according to the following formulae:

$$\Delta QF = \frac{QF_{\text{according to the invention}} - QF_{\text{comparison}}}{QF_{\text{comparison}}} \cdot 100$$

$$\Delta NKF = \frac{NKF_{\text{according to the invention}} - NKF_{\text{comparison}}}{NKF_{\text{comparison}}} \cdot 100$$

The results of this comparison are summarized in the Table below:

| | Δ QF | Δ NKF |
|---|---|---|
| Polyacrylamide (comparison) | 0 | 0 |
| Latex 6 | 24% | 20% |
| Latex 12 | 32% | 26% |

As the results show, the properties of the layers are distinctly improved by the compounds according to the invention compared with those obtained with linear polymers.

EXAMPLE 2

A casting solution of 10 g of an aqueous 15% by weight gelatine solution, 24.2 g of aqueous latex 14 or 15 diluted to 6.2% by weight, 0.38 g of a 4% by weight aqueous solution of the wetting agent used for the preparation of latex A, and 0.6 g of a 5% by weight aqueous solution of 1,3,5-triacrylo-hexahydro-1,3,5-triazine was applied to a substrated support of polyethylene laminated paper, dried and stored for one day at 36° C. and 80% relative humidity.

The samples of mordant layers obtained were washed in water for 2 minutes and immersed for 1, 2 3 and 5 minutes, respectively, in an aqueous dye solution of 0.05 g of the compound:

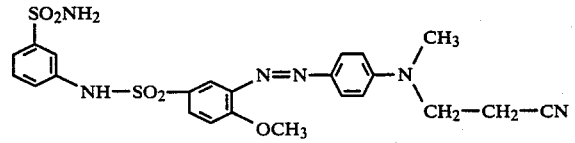

in 100 ml of phosphate buffer (pH 13.5). The mordant layers were strongly coloured after only one minute. The advantageous mordanting properties of the layers are demonstrated by the fact that the dye cannot be removed even by several hours' washing. The example was repeated with a cyan dye corresponding to the formula:

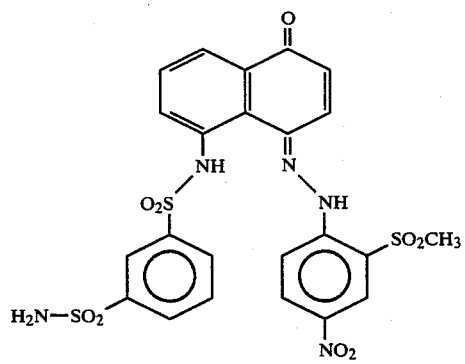

and a magenta dye corresponding to the formula:

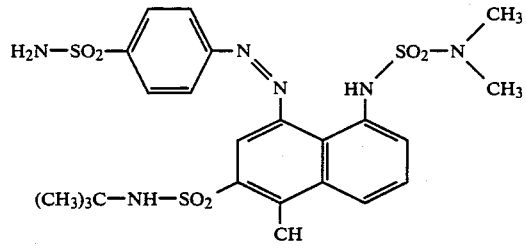

These samples were also able to withstand several hours' washing with water without losing color.

EXAMPLE 3

In this example, the latices according to the invention are compared with graft polymers of acrylamide described in U.S. Pat. No. 3,026,293. The viscosity of Latex 11 according to the invention was compared with that of the copolymer mixture described in Example 1 of U.S. Pat. No. 3,026,293. The viscosities were measured as outflow times of a 10% by weight polymer dispersion from a DIN cup (4 mm nozzle).

| | DIN cup (4 mm) outflow time |
|---|---|
| Copolymer corresponding to | 1000 sec. |

-continued

| | DIN cup (4 mm) outflow time |
|---|---|
| Example 1 of US-PS 3 026 293 (comparison) | |
| Latex 11 | 45 sec. |

This example demonstrates the more advantageous viscosity characteristics of the latex according to the invention compared with those of the polymer of U.S. Pat. No. 3,026,293, which is built up of similar monomers.

EXAMPLE 4

Latex 16 was added to a silver halide gelatine emulsion which had been sensitised to red according to the colour coupler introduced. The silver halide gelatine emulsion consisted of 75 g of silver iodobromide (iodide content 3 mol-%) and 72 g of gelatine, based on 1 kg of emulsion.

The emulsion prepared as described above was applied to a cellulose triacetate support coated with an adhesive layer, and dried. Photographic examination:

The sample was exposed by means of a sensitometer and then processed as described below. The relative sensitivity and the colour yield were determined.

| | |
|---|---|
| Color developer: | |
| Sodium phosphate: | 2 g |
| Sodium sulfite, anhydrous | 2 g |
| NaOH, 10% | 5 ml |
| Sodium carbonate, anhydrous | 50 g |
| Potassium bromide | 1 g |
| N—ethyl-N—(β-methanesulfonamido)-ethyl-4-amino-3-methyl aniline-sesquisulfate | 5 g |
| Benzyl alcohol | 3 ml |
| Water up to | 1000 ml |
| pH | 10.75 |
| Bleaching bath: | |
| Ethylene diaminotetracetic acid | 3 g |
| Potassium hexacyanoferrate | 50 g |
| Potassium bromide | 15 g |
| Disodium hydrogen phosphate | 1 g |
| Potassium dihydrogen phosphate | 19 g |
| Water up to | 1000 ml |
| Fixing bath: | |
| Sodium thiosulfate cryst. | 200 g |
| Water up to | 1000 ml |
| Development times (at 25° C.) | |
| Colour development | 12 min |
| Rinsing | 15 min |
| Bleaching bath | 5 min |
| Rinsing | 5 min |
| Fixing bath | 5 min |
| Final washing | 10 min |

The material used for comparison was one which instead of latex 16 according to the invention contained 2,4-dichloro-3-methyl-6-(tridecylcarbonamido)-phenol dissolved in tricresylphosphate in the form of an emulsion.

| Color coupler | relative sensitivity | Gamma | Color yield |
|---|---|---|---|
| Latex according to Example 4 | 70 | 1.75 | 2.35 |
| Comparison | 74 | 1.70 | 2.04 |

The relative sensitivity was determined by means of a sensitometer.

The lower number means higher sensitivity (3 units corresponds to one DIN). The example shows that higher sensitivities and colour yields are obtained with the latices according to the invention containing color couplers.

EXAMPLE 5

Examination of latex 17 as a color coupler was carried out as described in Example 4. The results were as follows:

| | |
|---|---|
| Relative Sensitivity | 68 |
| Gamma | 1.70 |
| Color yield | 2.28 |

EXAMPLE 6

200 ml of latex 10 were adjusted to pH 13.5 with sodium hydroxide solution. The viscosity was determined in a DIN cup with a 2 mm nozzle (outflow time in sec). The latex was then heated to 50° C. for 24 hours and the outflow time was again determined:

| | |
|---|---|
| Outflow time before heat treatment | 45 sec. |
| Outflow time after heat treatment | 44 sec. |

This result confirms that the cross-linking points are not dissolved by the heat treatment in the alkaline medium, which means that the latex is stable under the conditions indicated.

I claim:

1. A photographic recording material comprising a layer support, one or more gelatin containing layers in which at least one layer is a light sensitive silver halide emulsion layer and the binder of at least one of the gelatin-containing layers consisting of at least 20% by weight of latices of cross-linked microgel particle-shaped water insoluble copolymer, the copolymer being represented by the following formula:

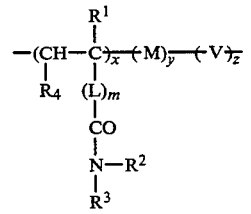

wherein $R^1$ denotes a hydrogen atom or an alkyl group having 1 to 6 carbon atoms, $R^2$ denotes a hydrogen atom, a substituted or unsubstituted alkyl group having 1 to 6 carbon atoms, an aralkyl group, a substituted or unsubstituted aryl group, a 5-membered or 6-membered substituted or unsubstituted heterocyclic ring containing oxygen, sulfur or nitrogen, $R^3$ has the meaning of $R^2$, and $R^2$ and $R^3$ may be identical or different, with the proviso that $R^2$ or $R^3$ must not be a residue of an agent which is active in the photographic layer, $R^4$ denotes a hydrogen atom or the group —$COOR^1$, L denotes an alkylene residue having 1 to 6 carbon atoms, an arylene residue having 6 to 10 carbon atoms, an arylenealkylene residue having 7 to 11 carbon atoms or a group —$COOR^5$ or —$CONHR^5$ wherein $R^5$ denotes one of the bivalent residues mentioned above, M denotes a residue of polymerized monomers containing an ethylenically unsaturated group, V denotes a residue of a polymerized monomer containing at least two ethylenically unsaturated groups, m is 0 or 1, x represents at least 10% by weight, y represents 89.5 to 0% by weight, z represents 10 to 0.5% by weight, and the sum of proportions by weight x, y and z should in each case be 100% and wherein the copolymer particles have a diameter of from 20 nm to 1 μm.

2. A recording material according to claim 1, characterized in that if Y is greater than 0M is a water-soluble monomer from the group consisting of acrylic acid, methacrylic acid, itaconic acid, maleic acid, acrylamido-2-methylpropene sulfonic acid, sulfoethyl methacrylate, N-vinylpyrrolidone, vinyl pyridine and dimethylaminoethyl methacrylate, and V denotes a polymerised monomer corresponding to the formula:

$$(CH_2{=}\overset{\overset{R^6}{|}}{C})_n{-}R^7$$

wherein $R^6$ denotes a hydrogen atom or a methyl group, $R^7$ denotes an n-valent organic residue and n denotes 2, 3 or 4.

* * * * *